US008048291B2

(12) United States Patent
Subramanian et al.

(10) Patent No.: US 8,048,291 B2
(45) **Date of Patent: *Nov. 1, 2011**

(54) HEAVY OIL UPGRADER

(75) Inventors: Anand Subramanian, Sugar Land, TX (US); Raymond Floyd, Katy, TX (US)

(73) Assignee: Kellogg Brown & Root LLC, Houston, TX (US)

( * ) Notice: Subject to any disclaimer, the term of this patent is extended or adjusted under 35 U.S.C. 154(b) by 149 days.

This patent is subject to a terminal disclaimer.

(21) Appl. No.: 11/965,038

(22) Filed: Dec. 27, 2007

(65) Prior Publication Data

US 2009/0166254 A1 Jul. 2, 2009

(51) Int. Cl.
*C10G 1/04* (2006.01)
*C10C 3/08* (2006.01)

(52) U.S. Cl. ..... 208/86; 208/45; 208/87; 208/128; 208/130

(58) Field of Classification Search ..... 208/45, 208/86, 87, 309, 128, 130
See application file for complete search history.

(56) References Cited

U.S. PATENT DOCUMENTS

| | | | | |
|---|---|---|---|---|
| 2,940,920 | A | | 6/1960 | Garwin |
| 3,975,396 | A | | 8/1976 | Bushnell et al. |
| 4,039,429 | A | | 8/1977 | van Klinken et al. |
| 4,191,639 | A | | 3/1980 | Audeh et al. |
| 4,200,519 | A | | 4/1980 | Kwant et al. |
| 4,290,880 | A | | 9/1981 | Leonard |
| 4,305,814 | A | * | 12/1981 | Leonard ..... 208/309 |
| 4,324,651 | A | | 4/1982 | Rollmann et al. |
| 4,354,922 | A | | 10/1982 | Derbyshire et al. |
| 4,354,928 | A | | 10/1982 | Audeh et al. |
| 4,421,639 | A | | 12/1983 | Lambert et al. |
| 4,440,633 | A | | 4/1984 | Jacquin et al. |
| 4,454,023 | A | * | 6/1984 | Lutz ..... 208/96 |
| 4,482,453 | A | | 11/1984 | Coombs et al. |
| 4,502,950 | A | | 3/1985 | Ikematsu et al. |
| 4,525,269 | A | | 6/1985 | Ikematsu et al. |
| 4,547,292 | A | | 10/1985 | Zarchy |
| 4,810,367 | A | | 3/1989 | Chombart et al. |
| 4,933,067 | A | | 6/1990 | Rankel |
| 5,089,114 | A | | 2/1992 | Tovar et al. |
| 5,192,421 | A | | 3/1993 | Audeh et al. |
| 5,843,303 | A | | 12/1998 | Ganeshan |
| 5,914,010 | A | | 6/1999 | Hood et al. |
| 5,919,355 | A | | 7/1999 | Hood |
| 6,274,032 | B2 | | 8/2001 | Hood et al. |
| 6,332,975 | B1 | | 12/2001 | Abdel-Halim et al. |
| 6,524,469 | B1 | | 2/2003 | Schucker |
| 6,533,925 | B1 | * | 3/2003 | Wallace et al. ..... 208/309 |
| 7,144,498 | B2 | | 12/2006 | McCall et al. |
| 2001/0002654 | A1 | * | 6/2001 | Hood et al. ..... 208/309 |

* cited by examiner

*Primary Examiner* — Walter Griffin
*Assistant Examiner* — Renee E Robinson
(74) *Attorney, Agent, or Firm* — KBR IP Legal Dept.

(57) ABSTRACT

Systems and methods for processing one or more hydrocarbons are provided. One or more hydrocarbons can be selectively separated to provide one or more heavy deasphalted oils. At least a portion of the heavy deasphalted oil can be thermally cracked to provide one or more lighter hydrocarbon products.

15 Claims, 3 Drawing Sheets

HEAVY OIL UPGRADER

BACKGROUND

1. Field

The present embodiments generally relate to processes for upgrading hydrocarbons. More particularly, embodiments of the present invention relate to processes for upgrading hydrocarbons using a solvent de-asphalting unit, visbreaker and/or fluid catalytic cracker.

2. Description of the Related Art

Solvent de-asphalting ("SDA") processes have been used to treat heavy hydrocarbons using a solvent to generate asphaltic and de-asphalted oil ("DAO") products. The asphaltic and DAO products are typically further treated and/or processed into useful products.

Solvent deasphalting can be economically attractive when downstream treatment facilities such as hydrotreating, fluid catalytic cracking, or visbreaking are adequately sized to process the large volume of DAO generated. Since the DAO produced using a solvent deasphalting process typically contains a mixture of both high and low viscosity oils, additional processing, such as visbreaking, is necessary to reduce the viscosity of the DAO. Treating the entire volume of DAO produced can require a substantial investment in capital equipment and supporting infrastructure, often making the installation financially unattractive in remote locations.

A need exists for an improved process to efficiently upgrade de-asphalted oil by reducing the viscosity of the de-asphalted oil to provide pipeline quality, lower viscosity, synthetic, crude oil.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

A detailed description will now be provided. Each of the appended claims defines a separate invention, which for infringement purposes is recognized as including equivalents to the various elements or limitations specified in the claims. Depending on the context, all references below to the "invention" may in some cases refer to certain specific embodiments only. In other cases it will be recognized that references to the "invention" will refer to subject matter recited in one or more, but not necessarily all, of the claims. Each of the inventions will now be described in greater detail below, including specific embodiments, versions and examples, but the inventions are not limited to these embodiments, versions or examples, which are included to enable a person having ordinary skill in the art to make and use the inventions, when the information in this patent is combined with available information and technology.

Systems and methods for processing one or more hydrocarbons are provided. One or more hydrocarbons can be selectively separated to provide one or more heavy deasphalted oils. At least a portion of the heavy deasphalted oil can be thermally cracked to provide one or more lighter hydrocarbon products.

Figure 1:
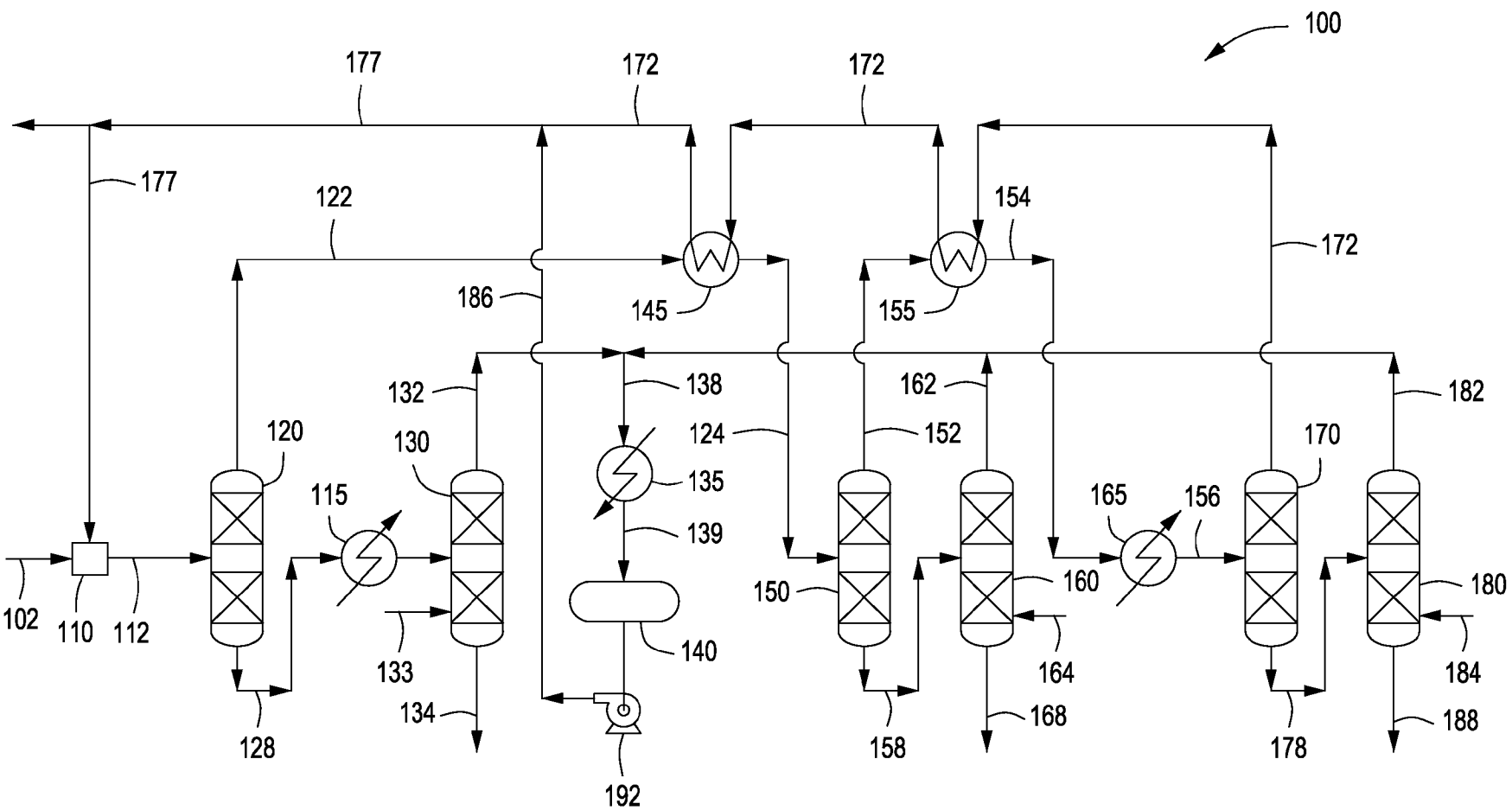
FIG. 1 depicts an illustrative extraction system according to one or more embodiments described.

FIG. 1 depicts an illustrative extraction system 100 according to one or more embodiments. The extraction system 100 can include one or more mixers 110, separators (three are shown 120, 150, 170) and strippers (three are shown 130, 160, 180) for the selective separation of the hydrocarbon mixture in line 112 into an asphaltene fraction via line 134, a heavy-DAO ("resin") fraction via line 168, and a light-DAO fraction via line 188. In one or more embodiments, the temperature of the contents of line 122 can be increased above the temperature in the asphaltene separator 120 to promote the separation of light-DAO and heavy-DAO fractions. In one or more embodiments, the separation of the DAO present in line 122 into light and heavy fractions can be accomplished by increasing the temperature of the contents of line 122 above the critical temperature of the one or more solvents, i.e. to supercritical conditions based upon the solvent in line 122. At temperatures greater than the temperature in the asphaltene separator 120 including, but not limited to, supercritical conditions with respect to the solvent, the light-DAO and the heavy-DAO can be separated using the one or more separators 150. Any residual solvent can be stripped from the heavy-DAO using the stripper 160 to provide a heavy-DAO via line 168.

The term "light deasphalted oil" ("light-DAO") as used herein refers to a hydrocarbon or mixture of hydrocarbons sharing similar physical properties and containing less than 5%, 4%, 3%, 2% or 1% asphaltenes. In one or more embodiments, the similar physical properties can include a boiling point of about 315° C. (600° F.) to about 610° C. (1,130° F.); a viscosity of about 40 cSt to about 65 cSt at 50° C. (120° F.); and a flash point of about 130° C. (265° F.) or more.

The term "heavy deasphalted oil" ("heavy-DAO") as used herein refers to a hydrocarbon or mixture of hydrocarbons sharing similar physical properties and containing less than 5%, 4%, 3%, 2% or 1% asphaltenes. In one or more embodiments, the similar physical properties can include a boiling point of about 400° C. (750° F.) to about 800° C. (1,470° F.); a viscosity of about 50 cSt to about 170 cSt at 50° C. (120° F.); and a flash point of about 150° C. (300° F.) or more.

The term "deasphalted oil" ("DAO") as used herein refers to a mixture of light deasphalted and heavy deasphalted oils.

The term "solvent" and "solvents" as used herein refers to one or more alkanes or alkenes with three to seven carbon atoms ($C_3$ to $C_7$), mixtures thereof, derivatives thereof and combinations thereof. In one or more embodiments, the solvating hydrocarbon has a normal boiling point or bulk normal boiling point of less than 538° C. (1,000° F.).

In one or more embodiments, the feedstock via line 102 and one or more solvents via line 177 can be mixed or otherwise combined using one or more mixers 110 to provide a hydrocarbon mixture ("first mixture") in line 112. In one or more embodiments, at least a portion of the feedstock in line 102 can be one or more unrefined and/or partially refined hydrocarbons including, but not limited to, atmospheric tower bottoms, vacuum tower bottoms, crude oil, oil shales, oil sands, tars, bitumens, combinations thereof, derivatives thereof and mixtures thereof. In one or more specific embodiments, the feedstock can include one or more atmospheric distillation tower bottoms that partially or completely bypass a vacuum distillation unit and are fed directly to the extraction system 100. In one or more embodiments, the feedstock can include one or more hydrocarbons that are insoluble in the one or more solvents supplied via line 177. In one or more specific embodiments, the feedstock can have a specific gravity (at 60°) of less than 35. API, or more preferably less than 25° API.

In one or more embodiments, the flow of the one or more solvents in line 177 can be set to maintain a pre-determined solvent-to-feedstock weight ratio in line 112. The solvent-to-feedstock weight ratio can vary depending upon the physical properties and/or composition of the feedstock. For example, a high boiling point feedstock can require greater dilution with low boiling point solvent(s) to obtain the desired bulk boiling point for the resultant mixture. The hydrocarbon mixture in line 112 can have a solvent-to-feedstock dilution ratio of about 1:1 to about 100:1; about 2:1 to about 10:1; or about 3:1 to about 6:1. In one or more embodiments, the hydrocarbon mixture in line 112 can have a specific gravity (at 60° F.) of about −5° API to about 35° API; or about 6° API to about 20° API. The solvent concentration in the hydrocarbon mixture in line 112 can range from about 50% wt to about 99% wt; 60% wt to about 95% wt; or about 66% wt to about 86% wt solvent(s). The hydrocarbon mixture in line 112 can contain from about 1% wt to about 50% wt, from about 5% wt to about 40% wt, or from about 14% wt to about 34% wt feedstock.

The one or more mixers 110 can be any device or system suitable for batch, intermittent, and/or continuous mixing of the feedstock(s) and solvent(s). The mixer 110 can be capable of homogenizing immiscible fluids. Illustrative mixers can include but are not limited to ejectors, inline static mixers, inline mechanical/power mixers, homogenizers, or combinations thereof. The mixer 110 can operate at temperatures of about 25° C. (80° F.) to about 600° C. (1,110° F.); about 25° C. (80° F.) to about 500° C. (930° F.); or about 25° C. (80° F.) to about 300° C. (570° F.). The mixer 110 can operate at pressures of about 101 kPa (0 psig) to about 2,800 kPa (390 psig); about 101 kPa (0 psig) to about 1,400 kPa (190 psig); or about 101 kPa (0 psig) to about 700 kPa (90 psig). In one or more embodiments, the mixer 110 can operate at a pressure exceeding the operating pressure of the asphaltene separator 120 by a minimum of about 35 kPa (5 psig); about 70 kPa (10 psig); about 140 kPa (20 psig); or about 350 kPa (50 psig).

In one or more embodiments, the first mixture in line 112 can be introduced to the one or more separators ("asphaltene separators") 120 to provide an overhead via line 122 and a bottoms via line 128. The overhead ("second mixture") in line 122 can contain deasphalted oil ("DAO") and a first portion of the one or more solvent(s). The bottoms in line 128 can contain insoluble asphaltenes and the balance of the one or more solvent(s). In one or more embodiments, the DAO concentration in line 122 can range from about 1% wt to about 50% wt; about 5% wt to about 40% wt; or about 14% wt to about 34% wt. In one or more embodiments, the solvent concentration in line 122 can range from about 50% wt to about 99% wt; about 60% wt to about 95% wt; or about 66% wt to about 86% wt. In one or more embodiments, the density (at 60° F.) of the overhead in line 122 can range from about 100° API; about 30° API to about 100° API; or about 50° API to about 100° API.

The term "asphaltenes" as used herein refers to a hydrocarbon or mixture of hydrocarbons that are insoluble in n-alkanes, yet is totally or partially soluble in aromatics such as benzene or toluene.

In one or more embodiments, the asphaltene concentration in the bottoms in line 128 can range from about 10% wt to about 99% wt; about 30% wt to about 95% wt; or about 50% wt to about 90% wt. In one or more embodiments, the solvent concentration in line 128 can range from about 1% wt to about 90% wt; about 5% wt to about 70% wt; or about 10% wt to about 50% wt.

The one or more separators 120 can include any system or device suitable for separating one or more asphaltenes from the hydrocarbon feed and solvent mixture to provide the overhead in line 122 and the bottoms in line 128. In one or more embodiments, the separator 120 can contain bubble trays, packing elements such as rings or saddles, structured packing, or combinations thereof. In one or more embodiments, the separator 120 can be an open column without internals. In one or more embodiments, the separators 120 can operate at a temperature of about 15° C. (60° F.) to about 150° C. (270° F.) above the critical temperature of the one or more solvent(s) ("$T_{C,S}$"); about 15° C. (60° F.) to about $T_{C,S}$+100° C. ($T_{C,S}$+180° F.); or about 15° C. (60° F.) to about $T_{C,S}$+50° C. ($T_{C,S}$+90° F.). In one or more embodiments, the separators 120 can operate at a pressure of about 101 kPa (0 psig) to about 700 kPa (100 psig) above the critical pressure of the solvent(s) ("$P_{C,S}$"); about $P_{C,S}$−700 kPa ($P_{C,S}$−100 psig) to about $P_{C,S}$+700 kPa ($P_{C,S}$+100 psig); or about $P_{C,S}$−300 kPa ($P_{C,S}$−45 psig) to about $P_{C,S}$+300 kPa ($P_{C,S}$+45 psig).

In one or more embodiments, the bottoms in line 128 can be heated using one or more heat exchangers 115, introduced to one or more strippers 130, and selectively separated therein to provide an overhead via line 132 and a bottoms via line 134. In one or more embodiments, the overhead via line 132 can contain a first portion of one or more solvent(s), and the bottoms in line 134 can contain a mixture of insoluble asphaltenes and the balance of the one or more solvent(s). In one or more embodiments, steam, via line 133, can be added to the stripper to enhance the separation of the one or more solvents from the asphaltenes. In one or more embodiments, the steam in line 133 can be at a pressure ranging from about 200 kPa (15 psig) to about 2,160 kPa (300 psig); from about 300 kPa (30 psig) to about 1,475 kPa (200 psig); or from about 400 kPa (45 psig) to about 1,130 kPa (150 psig). In one or more embodiments, the bottoms in line 128 can be heated to a temperature of about 100° C. (210° F.) to about $T_{C,S}$+150° C. ($T_{C,S}$+270° F.); about 150° C. (300° F.) to about $T_{C,S}$+100° C. ($T_{C,S}$+180° F.); or about 300° C. (570° F.) to about $T_{C,S}$+50° C. ($T_{C,S}$+90° F.) using one or more heat exchangers 115. In one or more embodiments, the solvent concentration in the overhead in line 132 can range from about 70% wt to about 99% wt; or about 85% wt to about 99% wt. In one or more embodiments, the DAO concentration in the overhead in line 132 can range from about 0% wt to about 50% wt; about 1% wt to about 30% wt; or about 1% wt to about 15% wt.

In one or more embodiments, the solvent concentration in the bottoms in line 134 can range from about 5% wt to about 80% wt; about 20% wt to about 60% wt; or about 25% wt to about 50% wt. In one or more embodiments, at least a portion of the bottoms in line 134 can be further processed, dried and pelletized to provide a solid hydrocarbon product. In one or more embodiments, at least a portion of the bottoms in line 134 can be subjected to further processing, including but not limited to gasification, power generation, process heating, or combinations thereof. In one or more embodiments, at least a portion of the bottoms in line 134 can be sent to a gasifier to produce steam, power, and hydrogen. In one or more embodiments, at least a portion of the bottoms in line 134 can be used as fuel to produce steam and power. In one or more embodiments, the asphaltene concentration in the bottoms in line 134 can range from about 20% wt to about 95% wt; about 40% wt to about 80% wt; or about 50% wt to about 75% wt. In one or more embodiments, the specific gravity (at 60° F.) of the bottoms in line 134 can range from about 5° API to about 30° API; about 5° API to about 20° API; or about 5° API to about 15° API.

The one or more heat exchangers 115 can include any system or device suitable for increasing the temperature of the bottoms in line 128. Illustrative heat exchangers, systems or devices can include, but are not limited to shell-and-tube, plate and frame, or spiral wound heat exchanger designs. In one or more embodiments, a heating medium such as steam, hot oil, hot process fluids, electric resistance heat, hot waste fluids, or combinations thereof can be used to transfer the necessary heat to the bottoms in line 128. In one or more embodiments, the one or more heat exchangers 115 can be a direct fired heater or the equivalent. In one or more embodiments, the one or more heat exchangers 115 can operate at a temperature of about 25° C. (80° F.) to about $T_{C,S}$+150° C. ($T_{C,S}$+270° F.); about 25° C. (80° F.) to about $T_{C,S}$+100° C. ($T_{C,S}$+180° F.); or about 25° C. (80° F.) to about $T_{C,S}$+50° C. ($T_{C,S}$+90° F.). In one or more embodiments, the one or more heat exchangers 115 can operate at a pressure of about 100 kPa (0 psig) to about $P_{C,S}$+700 kPa ($P_{C,S}$+100 psig); about 100 kPa to about $P_{C,S}$+500 kPa ($P_{C,S}$+75 psig); or about 100 kPa to about $P_{C,S}$+300 kPa ($P_{C,S}$+45 psig).

The one or more asphaltene strippers 130 can include any system or device suitable for selectively separating the bottoms in line 128 to provide an overhead in line 132 and a bottoms in line 134. In one or more embodiments, the asphaltene stripper 130 can contain internals such as rings, saddles, balls, irregular sheets, tubes, spirals, trays, baffles, or the like, or any combinations thereof. In one or more embodiments, the asphaltene stripper 130 can be an open column without internals. In one or more embodiments, the one or more asphaltene strippers 130 can operate at a temperature of about 30° C. (85° F.) to about 600° C. (1,110° F.); about 100° C. (210° F.) to about 550° C. (1,020° F.); or about 300° C. (570° F.) to about 550° C. (1,020°). In one or more embodiments, the one or more asphaltene strippers 130 can operate at a pressure of about 100 kPa (0 psig) to about 4,000 kPa (565 psig); about 500 kPa (60 psig) to about 3,300 kPa (465 psig); or about 1,000 kPa (130 psig) to about 2,500 kPa (350 psig).

In one or more embodiments, the asphaltene stripper overhead in line 122 can be heated using one or more heat exchangers 145 to sub-critical, critical or super-critical conditions based upon the critical temperature of the one or more solvents, providing a heated overhead in line 124. In one or more embodiments, the heated overhead in line 124 can be at a temperature in excess of the critical temperature of the solvent thereby enhancing the separation of the DAO into a heterogeneous mixture containing a light-DAO fraction and a heavy-DAO fraction in the one or more separators 150. In one or more embodiments, the temperature of the heated overhead in line 124 can range from about 15° C. (60° F.) to about $T_{C,S}$+150° C. ($T_{C,S}$+270° F.); about 15° C. (60° F.) to about $T_{C,S}$+100° C. ($T_{C,S}$+210° F.); or about 15° C. (60° F.) to about $T_{C,S}$+50° C. ($T_{C,S}$+90° F.).

Within the one or more separators 150, the heated overhead in line 124 can fractionate into a heavy-DAO fraction and a light-DAO fraction. The heavy-DAO fraction, withdrawn as a bottoms via line 158, can contain at least a portion of the heavy-DAO and a first portion of the one or more solvents. The light-DAO fraction, withdrawn as an overhead ("third mixture") via line 152, can contain at least a portion of the light-DAO and the balance of the one or more solvents. In one or more embodiments, the light-DAO concentration in the overhead in line 152 can range from about 1% wt to about 50% wt; about 5% wt to about 40% wt; or about 10% wt to about 30% wt. In one or more embodiments, the solvent concentration in the overhead in line 152 can range from about 50% wt to about 99% wt; about 60% wt to about 95% wt; or about 70% wt to about 90% wt. In one or more embodiments, the overhead in line 152 can contain less than about 20% wt heavy-DAO; less than about 10% wt heavy-DAO; or less than about 5% wt heavy-DAO.

In one or more embodiments, the heavy-DAO concentration in the bottoms in line 158 can range from about 10% wt to about 90% wt; about 25% wt to about 80% wt; or about 40% wt to about 70% wt. In one or more embodiments, the solvent concentration in the bottoms in line 158 can range from about 10% wt to about 90% wt; about 20% wt to about 75% wt; or about 30% wt to about 60% wt.

The one or more separators 150 can include any system or device suitable for separating the heated overhead in line 124 to provide an overhead via line 152 and a bottoms via line 158. In one or more embodiments, the separator 150 can include one or more multi-staged extractors having alternate segmental baffle trays, packing, perforated trays or the like, or combinations thereof. In one or more embodiments, the separator 150 can be an open column without internals. In one or more embodiments, the temperature in the one or more separators 150 can range from about 15° C. (60° F.) to about $T_{C,S}$+150° C. ($T_{C,S}$+270° F.); about 15° C. (60° F.) to about $T_{C,S}$+100° C. ($T_{C,S}$+210° F.); or about 15° C. (60° F.) to about $T_{C,S}$+50° C. ($T_{C,S}$+90° F.). In one or more embodiments, the pressure in the one or more separators 150 can range from about 100 kPa (0 psig) to about $P_{C,S}$+700 kPa ($P_{C,S}$+90 psig); about $P_{C,S}$−700 kPa ($P_{C,S}$−90 psig) to about $P_{C,S}$+700 kPa ($P_{C,S}$+90 psig); or about $P_{C,S}$−300 kPa ($P_{C,S}$−30 psig) to about $P_{C,S}$+300 kPa ($P_{C,S}$+30 psig).

The bottoms in line 158, containing heavy-DAO and the first portion of the one or more solvents, can be introduced into the one or more strippers 160 and selectively separated therein to provide an overhead, containing solvent, via line 162 and a bottoms, containing heavy-DAO, via line 168. The overhead in line 162 can contain a first portion of the solvent, and the bottoms in line 168 can contain heavy-DAO and the balance of the solvent. In one or more embodiments, steam via line 164 can be added to the stripper 160 to enhance the separation of solvent and the heavy-DAO therein. In one or more embodiments, at least a portion of the bottoms in line 168, containing heavy-DAO, can be directed for further processing including, but not limited to, upgrading through hydrotreating, catalytic cracking, or any combination thereof. In one or more embodiments, the steam in line 164 can be at a pressure ranging from about 200 kPa (15 psig) to about 2,160 kPa (300 psig); from about 300 kPa (30 psig) to about 1,475 kPa (200 psig); or from about 400 kPa (45 psig) to about 1,130 kPa (150 psig). In one or more embodiments, the solvent concentration in the overhead in line 162 can range from about 50% wt to about 100% wt; about 70% wt to about 99% wt; or about 85% wt to about 99% wt. In one or more embodiments, the heavy-DAO concentration in the overhead in line 162 can range from about 0% wt to about 50% wt; about 1% wt to about 30% wt; or about 1% wt to about 15% wt.

In one or more embodiments, the heavy-DAO concentration in the bottoms in line 168 can range from about 20% wt to about 95% wt; about 40% wt to about 80% wt; or about 50% wt to about 75% wt. In one or more embodiments, the solvent concentration in the bottoms in line 168 can range from about 5% wt to about 80% wt; about 20% wt to about 60% wt; or about 25% wt to about 50% wt. In one or more embodiments, the API gravity of the bottoms in line 168 can range from about 5° API to about 30° API; about 5° API to about 20° API; or about 5° API to about 15° API.

The one or more strippers 160 can include any system or device suitable for separating heavy-DAO and the one or more solvents to provide an overhead via line 162 and a bottoms via line 168. In one or more embodiments, the stripper 160 can contain internals such as rings, saddles, structured packing, balls, irregular sheets, tubes, spirals, trays, baffles, or any combinations thereof. In one or more embodiments, the stripper 160 can be an open column without internals. In one or more embodiments, the operating temperature of the one or more strippers 160 can range from about 15° C. (60° F.) to about 600° C. (1,110° F.); about 15° C. (60° F.) to about 500° C. (930° F.); or about 15° C. (60° F.) to about 400° C. (750° F.). In one or more embodiments, the pressure of the one or more strippers 160 can range from about 100 kPa (0 psig) to about 4,000 kPa (565 psig); about 500 kPa (60 psig) to about 3,300 kPa (465 psig); or about 1,000 kPa (130 psig) to about 2,500 kPa (350 psig).

In one or more embodiments, the overhead in line 152 can be heated using one or more first-stage heat exchangers 155 and one or more second-stage heat exchangers 165 to provide a heated overhead via line 154. The temperature of the heated overhead in line 154 can range from about 15° C. (60° F.) to about $T_{C,S}$+150° C. ($T_{C,S}$+270° F.); about 15° C. (60° F.) to about $T_{C,S}$+100° C. ($T_{C,S}$+180° F.); or about 15° C. (60° F.) to about $T_{C,S}$+50° C. ($T_{C,S}$+90° F.).

The one or more first stage heat exchangers 155 can include any system or device suitable for increasing the temperature of the overhead in line 152 to provide a heated overhead in line 154. In one or more embodiments, the temperature in the first stage heat exchanger 155 can range from about 15° C. (60° F.) to about $T_{C,S}$+150° C. ($T_{C,S}$+270° F.); about 15° C. (60° F.) to about $T_{C,S}$+100° C. ($T_{C,S}$+180° F.); or about 15° C. (60° F.) to about $T_{C,S}$+50° C. ($T_{C,S}$+90° F.). In one or more embodiments, the first stage heat exchanger 155 can operate at a pressure of about 100 kPa (0 psig) to about $P_{C,S}$+700 kPa ($P_{C,S}$+100 psig); about 100 kPa (0 psig) to about $P_{C,S}$+500 kPa ($P_{C,S}$+75 psig); or about 100 kPa (0 psig) to about $P_{C,S}$+300 kPa ($P_{C,S}$+45 psig).

The one or more second stage heat exchangers 165 can include any system or device suitable for increasing the temperature of the heated overhead in line 154. In one or more embodiments, the second stage heat exchangers 165 can operate at a temperature of about from about 15° C. (60° F.) to about $T_{C,S}$+150° C. ($T_{C,S}$+270° F.); about 15° C. (60° F.) to about $T_{C,S}$+100° C. ($T_{C,S}$+180° F.); or about 15° C. (60° F.) to about $T_{C,S}$+50° C. ($T_{C,S}$+90° F.). In one or more embodiments, the second stage heat exchangers 165 can operate at pressures of about 100 kPa (0 psig) to about $P_{C,S}$+700 kPa ($P_{C,S}$+100 psig); about 100 kPa (0 psig) to about $P_{C,S}$+500 kPa ($P_{C,S}$+75 psig); or about 100 kPa (0 psig) to about $P_{C,S}$+300 kPa ($P_{C,S}$+45 psig).

In one or more embodiments, the heated overhead in line 156 can be introduced to the one or more separators 170 and selectively separated therein to provide an overhead via line 172 and a bottoms via line 178. In one or more embodiments, the overhead in line 172 can contain at least a portion of the one or more solvent(s), and the bottoms in line 178 can contain a mixture of light-DAO and the balance of the one or more solvent(s). In one or more embodiments, the solvent concentration in line 172 can range from about 50% wt to about 100% wt; about 70% wt to about 99% wt; or about 85% wt to about 99% wt. In one or more embodiments, the light-DAO concentration in line 172 can range from about 0% wt to about 50% wt; about 1% wt to about 30% wt; or about 1% wt to about 15% wt.

In one or more embodiments, the light-DAO concentration in the bottoms in line 178 can range from about 10% wt to about 90% wt; about 25% wt to about 80% wt; or about 40% wt to about 70% wt. In one or more embodiments, the solvent concentration in line 178 can range from about 10% wt to about 90% wt; about 20% wt to about 75% wt; or about 30% wt to about 60% wt.

The one or more separators 170 can include any system or device suitable for separating the heated overhead in line 156 to provide an overhead containing solvent via line 172 and a light-DAO rich bottoms via line 178. In one or more embodiments, the separator 170 can include one or more multi-staged extractors having alternate segmental baffle trays, packing, structured packing, perforated trays, and combinations thereof. In one or more embodiments, the separator 170 can be an open column without internals. In one or more embodiments, the separators 170 can operate at a temperature of about 15° C. (60° F.) to about $T_{C,S}$+150° C. ($T_{C,S}$+270° F.); about 15° C. (60° F.) to about $T_{C,S}$+150° C. ($T_{C,S}$+270° F.); or about 15° C. (60° F.) to about $T_{C,S}$+50° C. ($T_{C,S}$+90° F.). In one or more embodiments, the separators 170 can operate at a pressure of about 100 kPa (0 psig) to about $P_{C,S}$+700 kPa ($P_{C,S}$+100 psig); about $P_{C,S}$−700 kPa ($P_{C,S}$−100 psig) to about $P_{C,S}$+700 kPa ($P_{C,S}$+100 psig); or about $P_{C,S}$−300 kPa ($P_{C,S}$−45 psig) to about $P_{C,S}$+300 kPa ($P_{C,S}$+45 psig).

In one or more embodiments, the bottoms, containing light-DAO, in line 178 can be introduced into the one or more strippers 180 and selectively separated therein to provide an overhead via line 182 and a bottoms via line 188. In one or more embodiments, the overhead in line 182 can contain at least a portion of the one or more solvent(s), and the bottoms in line 188 can contain a mixture of light-DAO and the balance of the one or more solvent(s). In one or more embodiments, steam via line 184 can be added to the stripper 180 to enhance the separation of the one or more solvents from the light-DAO. In one or more embodiments, at least a portion of the light-DAO in line 188 can be directed for further processing including, but not limited to hydrocracking. In one or more embodiments, the steam in line 184 can be at a pressure ranging from about 200 kPa (15 psig) to about 2,160 kPa (300 psig); from about 300 kPa (30 psig) to about 1,475 kPa (200 psig); or from about 400 kPa (45 psig) to about 1,130 kPa (150 psig). In one or more embodiments, the solvent concentration in the overhead in line 182 can range from about 50% wt to about 100% wt; about 70% wt to about 99% wt; or about 85% wt to about 99% wt. In one or more embodiments, the light-DAO concentration in line 182 can range from about 0% wt to about 50% wt; about 1% wt to about 30% wt; or about 1% wt to about 15% wt.

In one or more embodiments, the light-DAO concentration in the bottoms in line 188 can range from about 20% wt to about 95% wt; about 40% wt to about 90% wt; or about 50% wt to about 85% wt. In one or more embodiments, the solvent concentration in line 188 can range from about 5% wt to about 80% wt; about 10% wt to about 60% wt; or about 15% wt to about 50% wt. In one or more embodiments, the API gravity of the bottoms in line 188 can range from about 10° API to about 6° API; about 20° API to about 50° API; or about 25° API to about 45° API.

In one or more embodiments, the one or more strippers 180 can contain internals such as rings, saddles, structured packing, balls, irregular sheets, tubes, spirals, trays, baffles, or any combinations thereof. In one or more embodiments, the stripper 180 can be an open column without internals. In one or more embodiments, the one or more strippers 180 can operate at a temperature of about 15° C. (60° F.) to about $T_{C,S}$+150° C. ($T_{C,S}$+270° F.); about 15° C. (60° F.) to about $T_{C,S}$+100° C.

($T_{C,S}$+210° F.); or about 15° C. (60° F.) to about $T_{C,S}$+50° C. ($T_{C,S}$+90° F.). In one or more embodiments, the one or more strippers 180 can operate at a pressure of about 100 kPa (0 psig) to about $P_{C,S}$+700 kPa ($P_{C,S}$+100 psig); about $P_{C,S}$−700 kPa ($P_{C,S}$−100 psig) to about $P_{C,S}$+700 kPa ($P_{C,S}$+100 psig); or about $P_{C,S}$−300 kPa ($P_{C,S}$−45 psig) to about $P_{C,S}$+300 kPa ($P_{C,S}$+45 psig).

In one or more embodiments, at least a portion of the overhead in line 172 can be cooled using one or more heat exchangers 145 and 155 to provide a cooled overhead via line 172. In one or more embodiments, about 1% wt to about 95% wt; about 5% wt to about 55% wt; or about 1% wt to about 25% wt of overhead in line 172 can be cooled using one or more heat exchangers 145, 155. Recycling at least a portion of the solvent to the solvent deasphalting process depicted in FIG. 1 can decrease the quantity of fresh solvent make-up required. In one or more embodiments, prior to introduction to the one or more heat exchangers 155, the overhead in line 172 can be at a temperature of about 15° C. (60° F.) to about $T_{C,S}$+150° C. ($T_{C,S}$+270° F.); about 15° C. (60° F.) to about $T_{C,S}$+150° C. ($T_{C,S}$+270° F.); or about 15° C. (60° F.) to about $T_{C,S}$+50° C. ($T_{C,S}$+90° F.). In one or more embodiments, prior to introduction to the one or more heat exchangers 155, the overhead in line 172 can be at a pressure of about 100 kPa (0 psig) to about $P_{C,S}$+700 kPa ($P_{C,S}$+100 psig); about $P_{C,S}$−700 kPa ($P_{C,S}$−100 psig) to about $P_{C,S}$+700 kPa ($P_{C,S}$+100 psig); or about $P_{C,S}$−300 kPa ($P_{C,S}$−45 psig) to about $P_{C,S}$+300 kPa ($P_{C,S}$+45 psig).

In one or more embodiments, at least a portion of the solvent in the overhead in lines 132, 162 and 182 can be combined to provide a combined solvent in the overhead in line 138. In one or more embodiments, the solvent in the combined solvent overhead in line 138 can be present as a two phase liquid/vapor mixture. In one or more embodiments, the combined solvent overhead in line 138 can be fully condensed using one or more condensers 135 to provide a condensed solvent via line 139. In one or more embodiments, the condensed solvent in line 139 can be stored or accumulated using one or more accumulators 140. The solvent(s) stored in the one or more accumulators 140 for recycle within the extraction unit 100 can be transferred using one or more solvent pumps 192 and recycle line 186.

In one or more embodiments, the combined solvent overhead in line 138 can have a temperature of about 30° C. (85° F.) to about 600° C. (1,110° F.); about 100° C. (210° F.) to about 550° C. (1,020° F.); or about 300° C. (570° F.) to about 550° C. (1,020° F.). In one or more embodiments, the condensed solvent in line 139 can have a temperature of about 10° C. (50° F.) to about 400° C. (750° F.); about 25° C. (80° F.) to about 200° C. (390° F.); or about 30° C. (85° F.) to about 100° C. (210° F.). The solvent concentration in line 139 can range from about 80% wt to about 100% wt; about 90% wt to about 99% wt; or about 95% wt to about 99% wt.

The one or more condensers 135 can include any system or device suitable for decreasing the temperature of the combined solvent overhead in line 138. In one or more embodiments, condenser 135 can include, but is not limited to liquid or air cooled shell-and-tube, plate and frame, fin-fan, or spiral wound cooler designs. In one or more embodiments, a cooling medium such as water, refrigerant, air, or combinations thereof can be used to remove the necessary heat from the combined solvent overhead in line 138. In one or more embodiments, the one or more condensers 135 can operate at a temperature of about −20° C. (−5° F.) to about $T_{C,S}$° C.; about −10° C. (15° F.) to about 300° C. (570° F.); or about 0° C. (30° F.) to about 300° C. (570° F.). In one or more embodiments, the one or more coolers 175 can operate at a pressure of about 100 kPa (0 psig) to about $P_{C,S}$+700 kPa ($P_{C,S}$+100 psig); about 100 kPa (0 psig) to about $P_{C,S}$+500 kPa ($P_{C,S}$+75 psig); or about 100 kPa (0 psig) to about $P_{C,S}$+300 kPa ($P_{C,S}$+45 psig).

In one or more embodiments, all or a portion of the solvent in line 186 and all or a portion of the cooled solvent in line 172 can be combined to provide the solvent recycle via line 177. In one or more embodiments, at least a portion of the solvent recycle in line 177 can be recycled to the one or more mixers 110. Although not shown in FIG. 1, in one or more embodiments, at least a portion of the solvent in line 177 can be directed to another treatment process, for example an integrated solvent dewatering/deasphalting process.

Figure 2:
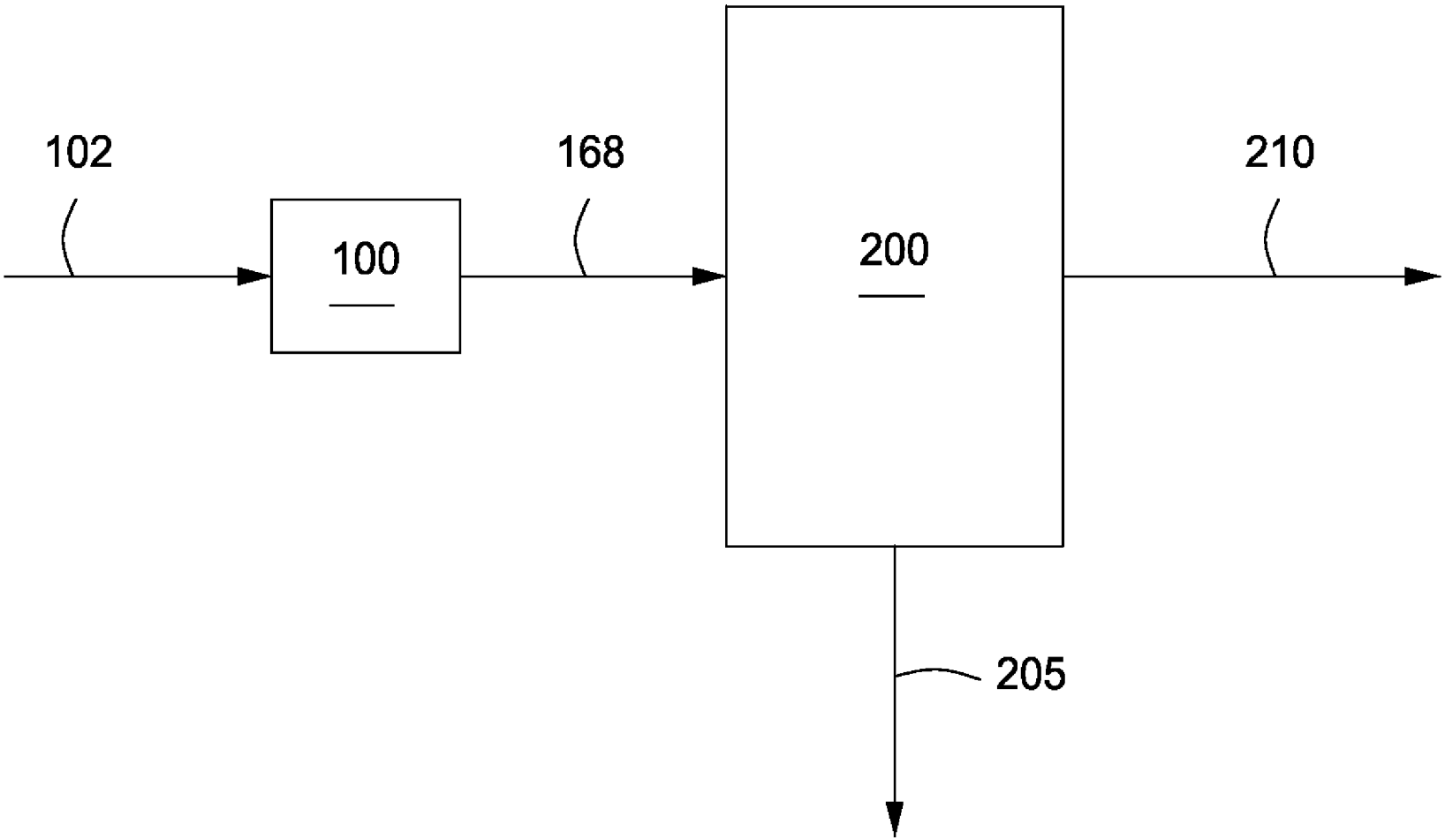
FIG. 2 depicts an illustrative treatment system for processing one or more hydrocarbons according to one or more embodiments described.

FIG. 2 depicts an illustrative treatment system 200 for processing one or more hydrocarbons according to one or more embodiments. In one or more embodiments, one or more thermal cracking units 200 can be used to reduce the viscosity, i.e. visbreak, of at least a portion of the heavy-DAO in line 168 into one or more lighter hydrocarbons which can be removed from the thermal cracking unit via line 210. In one or more embodiments, each thermal cracking unit 200 can include a furnace and a soaker.

In one or more embodiments, the heavy-DAO feed in line 168 can be preheated and sent to a furnace for heating to the cracking temperature. In one or more embodiments, the cracker can be operated at a temperature of from about 300° C. (570° F.) to about 600° C. (1,110° F.); about 350° C. (660° F.) to about 550° C. (1,020° F.); or about 400° C. (750° F.) to about 500° C. (930° F.). In one or more embodiments, the in the cracker can be operated at a pressure of from about 200 kPa (15 psig) to about 5,250 kPa (750 psig); about 310 kPa (30 psig) to about 3,200 kPa (450 psig); or about 400 kPa (45 psig) to about 1,820 kPa (250 psig).

In one or more embodiments, a soaker, or reaction chamber, can be located downstream of the furnace to provide additional reaction time. Since the cracking reactions within the soaker are endothermic, the temperature at the exit of the soaker can be lower than the furnace exit temperature. In one or more embodiments, the one or more light hydrocarbons exiting the soaker can be quenched to halt the cracking reactions and prevent excessive coke formation. In one or more embodiments, an up-flow soaker can be used to provide greater residence time within the soaker, permitting the use of a lower furnace temperature, and commensurately lower fuel usage in the furnace. The one or more light hydrocarbons can exit the soaker and be removed from the thermal cracking unit 200 via line 210. The light hydrocarbons in line 210 can be less viscous than the heavy-DAO introduced to the thermal cracking unit 200 via line 168.

Figure 3:
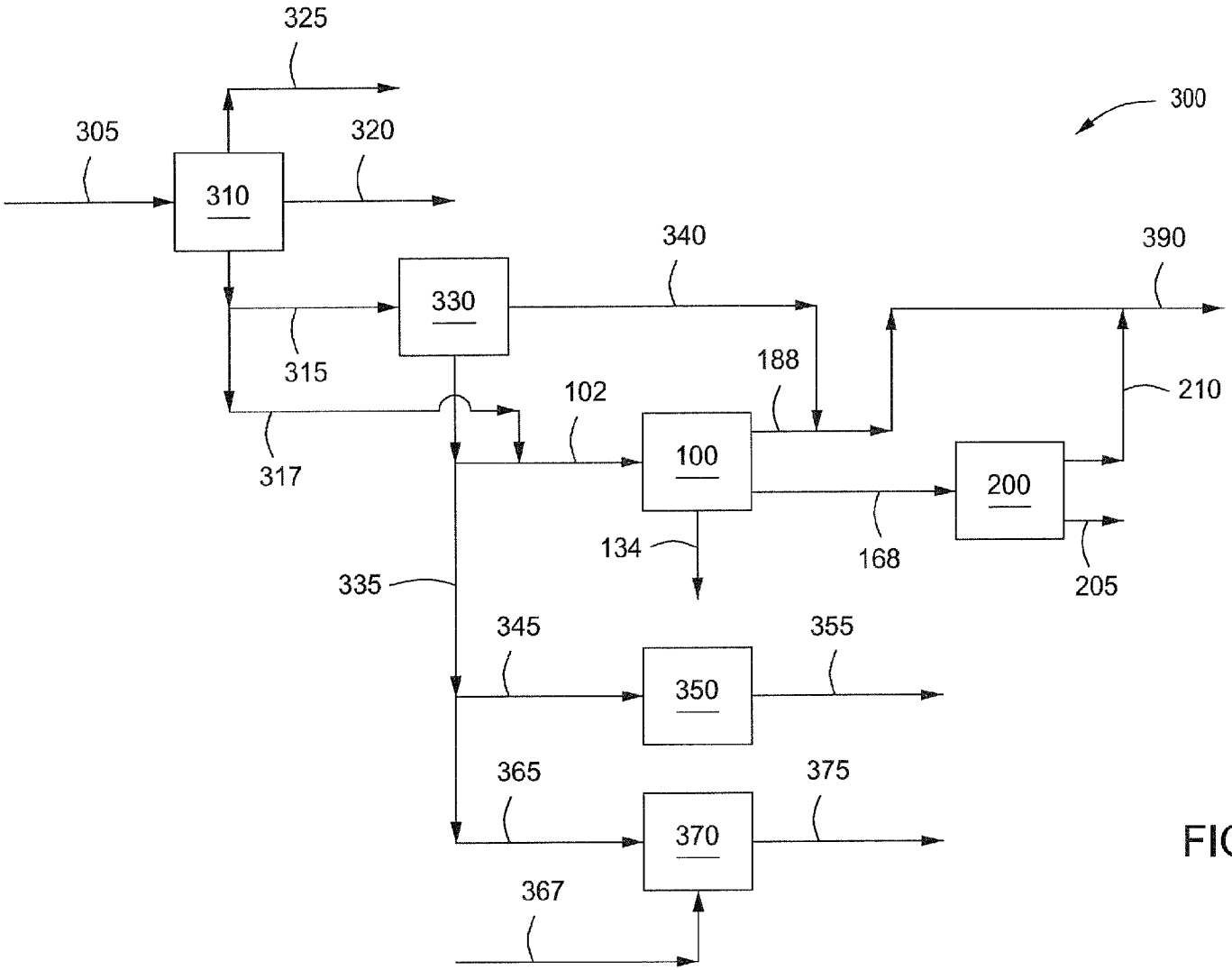
FIG. 3 depicts an illustrative system for producing one or more hydrocarbons according to one or more embodiments described.

FIG. 3 depicts an illustrative system 300 for producing one or more hydrocarbons according to one or more embodiments. In one or more embodiments, the refining unit can include, but is not limited to, one or more atmospheric distillation units ("ADU") 310, one or more vacuum distillation units ("VDU") 330, one or more solvent deasphalting units 100, one or more cokers 350, one or more resid hydrocrackers 370, and one or more thermal cracking units 200.

In one or more embodiments, a feed containing one or more crude oils via line 305, can be introduced to one or more atmospheric distillation units ("ADU") 310 to provide one or more light hydrocarbons via line 325, one or more intermediate hydrocarbons via line 320, and a bottoms via line 315. In one or more embodiments, the ADU bottoms in line 315 can contain one or more hydrocarbons having a boiling point greater than 538° C. (1,000° F.). In one or more embodiments, at least a portion of the ADU bottoms in line 315 can be introduced to one or more VDUs 330 to provide a vacuum gas oil ("VGO") via line 340, and a VDU bottoms via line 335. In one or more embodiments, the VDU bottoms in line 335 can include one or more high boiling point hydrocarbons having high levels of sulfur, nitrogen, metals, and/or Conradson Carbon Residue ("CCR"). In one or more embodiments, the VDU bottoms in line 335 can be apportioned equally or unequally between one or more of the following: the one or more solvent deasphalting units 100 via line 102, the one or more cokers 350 via line 345, and/or the one or more resid hydrocrackers 370 via line 365.

In one or more embodiments, at least a portion of the ADU bottoms in line 315 can bypass the vacuum distillation unit 330 via line 317 and instead be introduced directly to the solvent deasphalting unit 100. In one or more embodiments, a minimum of about 0% wt; about 10% wt; about 25% wt; about 50% wt; about 75% wt; about 90% wt; about 95% wt; or about 99% wt of the ADU bottoms in line 315 can bypass the vacuum distillation unit 330 via line 317 and be introduced directly to the solvent deasphalting unit 100. Within the one or more solvent deasphalting units 100, a substantial portion of the sulfur, nitrogen, metals and/or CCR present in the atmospheric distillation unit bottoms via line 315 can be removed with the asphaltenes via line 134 and/or the heavy-DAO via line 168. The light-DAO in line 188 can therefore contain one or more high-quality hydrocarbons having low levels of sulfur, nitrogen, metals and/or CCR. In one or more embodiments, the heavy-DAO in line 168 can be introduced to the one or more thermal cracking units 200, to provide one or more light hydrocarbon products via the overhead in line 210. In one or more embodiments, at least a portion of the light hydrocarbon products in line 210, can be combined with at least a portion of the light-DAO in line 188 to form one or more final products via line 390. In one or more embodiments, the finished product in line 390 can be a pipelineable synthetic crude oil.

In one or more embodiments, at least a portion of the VDU bottoms in line 335 can be introduced to one or more cokers 350 via line 345. In one or more embodiments, the coker 350 can thermally crack and soak the VDU bottoms at high temperature, thereby providing one or more light hydrocarbon products via line 355. In one or more embodiments, at least a portion of the VDU bottoms in line 335 can be introduced to one or more resid hydrocrackers 370 via line 365. In one or more embodiments, the resid hydrocracker 370 can catalytically crack the VDU bottoms in the presence of hydrogen introduced via line 367, thereby providing one or more light hydrocarbon products via line 375.

Certain embodiments and features have been described using a set of numerical upper limits and a set of numerical lower limits. It should be appreciated that ranges from any lower limit to any upper limit are contemplated unless otherwise indicated. Certain lower limits, upper limits and ranges appear in one or more claims below. All numerical values are "about" or "approximately" the indicated value, and take into account experimental error and variations that would be expected by a person having ordinary skill in the art.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

While the foregoing is directed to embodiments of the present invention, other and further embodiments of the invention may be devised without departing from the basic scope thereof, and the scope thereof is determined by the claims that follow.

What is claimed is:

1. A method for processing one or more hydrocarbons, comprising:

selectively separating one or more heavy deasphalted oils and one or more light deasphalted oils from one or more feedstocks, wherein the one or more feedstocks comprise crude oil, oil shales, oil sands, tars, bitumens, or any combination thereof, wherein the one or more heavy deasphalted oils have an API gravity at 60° F. ranging from about 5° API to about 30° API, and wherein the one or more light deasphalted oils have an API gravity at 60° F. ranging from about 0° API to about 60° API;

cracking at least a portion of the one or more heavy deasphalted oils using a thermal cracker to provide one or more lighter hydrocarbon products; and combining at least a portion of the one or more lighter hydrocarbon products and at least a portion of the one or more light deasphalted oils to provide a synthetic crude oil.

2. The method of claim 1,wherein the heavy deasphalted oil is selectively separated from the one or more feedstocks using a solvent extraction process comprising:

combining the one or more feedstocks with one or more solvents to provide a first mixture comprising the one or more solvents, one or more heavy oils, one or more light oils, and one or more asphaltenes;

selectively separating the one or more asphaltenes from the first mixture to provide a second mixture comprising the one or more solvents, one or more heavy deasphalted oils and one or more light deasphalted oils; and selectively separating the one or more heavy deasphalted oils from the second mixture to provide a third mixture comprising the solvents and the light deasphalted oils.

3. The method of claim 2, further comprising:

selectively separating the one or more solvents from the third mixture to recover the one or more light deasphalted oils.

4. The method of claim 2, wherein the solvent-to-feedstock weight ratio in the first mixture ranges from about 2:1 to about 100:1.

5. The method of claim 2, wherein the one or more asphaltenes are selectively separated from the first mixture at a temperature greater than 15° C. and at a pressure greater than 101 kPa.

6. The method of claim 2, wherein the one or more heavy deasphalted oils are selectively separated from the second mixture at a temperature greater than 15° C. and at a pressure greater than 101 kPa.

7. The method of claim 2, wherein the one or more solvents comprise one or more alkenes, one or more alkenes, or any mixture thereof, and wherein the alkenes and alkenes have from three to seven carbon atoms.

8. The method of claim 1, wherein the API gravity at 60° F. of the at least a portion of the one or more light deasphalted oils ranges from about 1.0° API to about 60° API when combined with the at least a portion of the one or more lighter hydrocarbon products.

9. A method for processing one or more hydrocarbons, comprising:

combining one or more feedstocks comprising one or more heavy oils one or more light oils, and one or more asphaltenes, with one or more solvents to provide a first mixture, wherein the one or more feedstocks consist essentially of crude oil, oil shales, oil sands, tars, bitumens, or any combination thereof;

selectively separating the one or more asphaltenes from the first mixture to provide a second mixture comprising the one or more solvents, one or more heavy deasphalted oils and one or more light deasphalted oils;

selectively separating the one or more heavy deasphalted oils from the second mixture to provide a third mixture comprising the one or more solvents and the one or more light deasphalted oils, wherein the one or more heavy deasphalted oils have an API gravity at 60° F. ranging from about 5° API to about 30° API;

selectively separating the one or more solvents from the third mixture to recover the one or more light deasphalted oils, wherein the one or more light deasphalted oils have an API: gravity at 60° F. ranging from about 10° API to about 60° API;

cracking at least a portion of the one or more separated heavy deasphalted oils using a thermal cracker to provide one or more light hydrocarbon products; and combining the one or more light hydrocarbon products with the one or more light deasphalted oils to form one or more products.

10. The method of claim 9, wherein the solvent-to-feedstock weight ratio ranges from about 2:1 to about 10:1.

11. The method of claim 9, wherein the one or more asphaltenes are selectively separated from the first mixture at a pressure greater than 101 kPa and at a temperature of from 15° C. to the critical temperature of the one or more solvents.

12. The method of claim 9, wherein the one or more heavy deasphalted oils are selectively separated from the second mixture at a pressure greater than 101 kPa and at a temperature of from 15° C. to the critical temperature of the one or more solvents.

13. The method of claim 9, wherein the one or more solvents are selectively separated from the third mixture at a pressure greater than 101 kPa and at a temperature of from about 15° C. to about the critical temperature of the one or more solvents.

14. The method of claim 9, wherein the one or more solvents comprise one or more alkenes, one or more alkenes, or any mixture thereof, and wherein the alkenes and alkenes have from three to seven carbon atoms.

15. The method of claim 9, wherein the API gravity at 60° F. of the one or more light deasphalted oils ranges from about 10° API to about 60° API when combined with the one or more light hydrocarbon products.

* * * * *